US006125918A

United States Patent [19]

Berge

[11] Patent Number: 6,125,918

[45] **Date of Patent: *Oct. 3, 2000**

[54] METHOD FOR MEASUREMENT OF AMOUNT OF LIQUID METAL IN CASTING FURNACE

[75] Inventor: Arnulf Berge, Kristiansand, Norway

[73] Assignee: Industriell Informasjonsteknologi AS, Norway

[ * ] Notice: This patent issued on a continued prosecution application filed under 37 CFR 1.53(d), and is subject to the twenty year patent term provisions of 35 U.S.C. 154(a)(2).

[21] Appl. No.: 08/945,659

[22] PCT Filed: Apr. 19, 1996

[86] PCT No.: PCT/NO96/00090

§ 371 Date: Feb. 25, 1998

§ 102(e) Date: Feb. 25, 1998

[87] PCT Pub. No.: WO96/34710

PCT Pub. Date: Nov. 7, 1996

[30] Foreign Application Priority Data

May 2, 1995 [NO] Norway ..... 951672

[51] Int. Cl.[7] ..... B22D 46/00; B22D 37/00

[52] U.S. Cl. ..... 164/457; 164/155.4; 164/136; 164/4.1

[58] Field of Search ..... 164/457, 155.4, 164/136, 337, 4.1; 223/604, 590

[56] References Cited

U.S. PATENT DOCUMENTS

| | | | |
|---|---|---|---|
| 4,600,047 | 7/1986 | Matoba et al. | 164/453 |
| 5,080,327 | 1/1992 | Bai | 266/230 |
| 5,381,855 | 1/1995 | Mezger | 164/457 |
| 5,409,054 | 4/1995 | Moriceau | 164/453 |
| 5,758,714 | 6/1998 | Sato et al. | 164/457 |

FOREIGN PATENT DOCUMENTS

| | | | |
|---|---|---|---|
| 201379 | 10/1990 | European Pat. Off. . | |
| 2430835 | 12/1977 | Germany . | |
| 61-18964 | 5/1986 | Japan | 222/590 |
| 62-218783 | 9/1987 | Japan . | |
| 1-215457 | 8/1989 | Japan | 222/590 |
| 4316979 | 9/1992 | Japan . | |

*Primary Examiner*—Harold Pyon
*Assistant Examiner*—I.-H. Lin
*Attorney, Agent, or Firm*—Bierman, Muserlian and Lucas

[57] ABSTRACT

The invention relates to a method for measuring the amount of liquid metal contained in a tiltable casting furnace. A reference curve is established for the amount of metal contained in the furnace and the tilt angle of the furnace. This reference curve is established by first calculating a theoretical curve based on the geometry of the furnace and then correcting the theoretical curve based on the volume of metal used between one tilt angle and a greater tilt angle. The amount of metal contained in the furnace is read from the reference curve after the curve has been corrected for any deviation between actual metal level and reference metal level.

10 Claims, 3 Drawing Sheets

METHOD FOR MEASUREMENT OF AMOUNT OF LIQUID METAL IN CASTING FURNACE

TECHNICAL FIELD

The present invention relates to a method for measurement of the amount of liquid metal in casting furnaces.

BACKGROUND ART

For a number of reasons it is a desire to know exactly how much metal which at all times is present in a casting furnace before start of casting, during the casting process and after finishing the casting process. During semi-continuous casting of bolts and rolling ingots of aluminium it is used casting furnaces which may contain 60–80 tons of molten aluminium. It is important that one prior to the casting process knows the amount of aluminium in the casting furnace in order to ensure that the bolts or the rolling ingots can be cast to a specified length. Further, it is important to know the amount of aluminium remaining in the furnace after finishing of the casting process, as the remaining amount of metal in the casting furnace will constitute the start of the next batch of aluminium prepared in the furnace, and one has to take this amount of metal into account in order to obtain a correct analysis of the aluminium alloy during production of the next batch in the furnace.

It is further known that the effective volume of casting furnaces changes during use of the furnaces, as the linings in the furnaces are subjected to wear resulting in an increased volume and build up of dross resulting in reduced volume. For instance, new casting furnaces for aluminium may contain 60 tons of molten aluminium while they after two to three years of use may contains 70 tons.

It is known to determine the amount of metal in such furnaces by weighing, but for a number of reasons it has been found that it is difficult and very costly to maintain a stable weighing system for such furnaces. Thus the furnace construction itself may weigh 200–300 tons and is subjected to substantial thermal and mechanical strain during operation. Further it is difficult to include volume changes in the furnace due to wear of lining, as this is dependent on completely emptying the furnace in order to weigh the empty furnace. Taring of a weighing system also necessitates complete emptying of the furnace. Calibration of a weighing system also necessitates complete emptying of the furnace and addition of known weights into the furnace. Both these functions will give interruption of the furnace operation. Further a weighing system can only be used to record the amount of metal in the furnace, and can not be used to record the amount of liquid metal in launders, filters etc. between the outlet of the furnace and the casting moulds. Finally a weighing system cannot itself detect when it is out of calibration. This implies that a weighing system must be calibrated or checked regularly.

DISCLOSURE OF INVENTION

It therefore exists a need for a reliable method for calculating the amount of metal in casting furnaces where the amount of metal in the casting furnace and the amount of metal in the launder system between the casting furnace and the casting moulds at any time during the casting process can be calculated and where the method takes into account wear and other volume changes in the casting furnace.

It is an object of the present invention to provide a method for measuring the amount of metal in tiltable casting furnaces based on monitoring the amount of metal which at any time during the casting process has been tapped from the furnace.

Accordingly, the present invention relates to a method for measuring the amount of liquid metal contained in tiltable casting furnaces, which method is characterised in that it is established and maintained a reference curve for the amount of metal in the furnace as a function of the furnace tilting angle at a reference level for metal at the furnace outlet opening and that the amount of metal contained in the casting furnace at any furnace tilting angle during the casting process is red from the reference curve after correction due to deviation of actual metal level from the reference metal level.

The reference curve for amount of metal in the furnace as a function of tilting angle is preferably established by calculating a curve for amount of metal in the furnace based on the furnace geometry, whereafter amounts of metal tapped from the furnace during a plurality of intervals from one tilting angle to a greater tilting angle while keeping a constant level of metal at the outlet opening of the furnace, are registered and calculating corresponding slopes to an exact curve for amount of metal tapped from the furnace as a function of tilting angle, based on the registered amounts of metal tapped from the furnace during the plurality of intervals from one tilting angle to a greater tilting angle, charging the furnace with a known amount of metal and tilting the furnace to a tilting angle where the metal level rises to the reference level in the furnace outlet opening, thereby determining one point for a known amount of metal in the furnace for a particular tilting angle, and where the reference curve for amount of metal in the furnace as a function of the furnace tilting angle runs through the determined point for amount of metal in the furnace for the particular tilting angle.

According to a preferred embodiment more than one exact point on the reference curve are determined for known amounts of metal charged to the furnace and the corresponding tilting angles where the metal level in the furnace during tilting rises to the reference level.

When establishing the reference curve, the amount of metal tapped from the furnace is registered as metal filled into the casting mould or moulds between one tilting angle and a greater tilting angle while keeping a constant level of metal at the outlet opening of the furnace. The amount of metal filled into the casting moulds is calculated based on the number of casting moulds, the cross-section of the casting moulds, the length of the castings at any time and the density of the metal. These data are easy to register and to store in computers.

The level of metal at the furnace outlet opening and in the launder system is monitored by means of one or more sensors. During the casting process the amount of liquid metal containing in the furnace at a certain furnace tilting angle is read from the reference curve provided that the actual metal level is equal to the reference level. If the actual registered metal level deviates from the reference level, the amount of metal in the furnace is adjusted in the following way: If the actual registered metal level is higher than the reference level, the registered amount of metal in the furnace is adjusted by adding a correction corresponding to the amount of metal in the furnace which is above the reference level. The amount of metal in the furnace between the reference level and registered actual metal level can be calculated based on the furnace geometry, the tilting angle and the distance from the reference level to the registered actual metal level.

If the registered actual metal level is lower than the reference level, the above correction is made by subtraction from the amount of metal in the furnace read from the reference curve.

In order to control the reference curve, the amount of metal tapped from the furnace for a plurality of intervals from one tilting angle to a greater tilting angle is registered for each casting from the furnace, and based on these registrations it is, calculated a curve which is compared with the reference curve. The curve which is calculated based on registered amounts of metal cast from the furnace as a function of tilting angles, is compared with curves giving acceptable limit values in relation to the reference curve. If the calculated curves for one or more successive castings from the casting furnace generally are outside the limit values for the reference curve, possible reasons for this is examined.

If it is found that the reason is incorrect registration of metal tapped from the furnace, no correction of the reference curve is made. If no such incorrectnesses are found, it is established a new reference curve for amount of metal in the furnace as a function of tilting angle based on a selection of slopes from a number of the preceeding castings or from a number of slopes from a number of future castings. If the calculated curves changes little from casting to casting before the curves for the limit value are exceeded, it is preferred to establish a new reference curve for amount of metal in the furnace as a function of tilting angle based upon a number of the closest preceding castings, as in this case the reason for the change will be a slowly change of the furnace volume, for instance as a result of lining wear.

If the calculated curves for one casting is strongly different from the calculated curves for the preceeding castings, it is preferred to establish a new reference curve for amount of metal in the furnace as a function of the furnace tilting angle based on a number of future castings, as in such cases the deviations is probably caused by a sudden volume change in the furnace, for instance caused by loosing bigger parts of the furnaces lining.

In this way a continuous control of the reference curve is achieved and the reference curve can at any time be replaced by a new reference curve.

By the method according to the present invention further advantages are obtained as the amount of metal contained in the furnace and the amount of metal contained in the launder system from the outlet opening of the furnace and to the casting moulds will be known at any time during the casting process. By vertical casting of a plurality of bolts or rolling ingots of aluminium or aluminium alloy which shall be cast to a predetermined length, this can be utilised if it for instance at some time during the casting process it is found that the remaining amount of metal in the furnace and in the launder system is to small to allow the bolts or rolling ingots to be cast to the predetermined length, the casting mould for one or more of the bolts or rolling ingots can be closed in order to ensure that the predetermined length is obtained for the remaining bolts or rolling ingots.

At the end of the casting process, the amount of metal remaining in the furnace will be known and this remaining amount of metal can be taken into consideration when calculating the chemical analysis of the next charge of metal to be produced in the furnace.

Further, the reference curves used can be stored and can be used in order to monitor the furnace condition, such as for example lining wear and dross build up. As the reference curves gives the amount of metal as a function of tilting angles, one can by comparing stored reference curves, be able to indicate in which part of the furnace the lining wear is strongest, and based on this, be able to determine the correct time for repairing the furnace lining.

The method according to the present invention further has the advantage that the reference curve for amount of metal in the furnace as a function of tilting angle can be calibrated and adjusted at any time based on stored values from preceeding castings.

During practical trials it has been found that by use of the method according to the present invention it is possible to obtain an accuracy better than ±1000 kg for a furnace containing 60 tons of liquid metal and that the accuracy increases with increasing tilting angle.

The method according to the present invention can easely be put into use on existing tiltable casting furnaces, as computers which normally are installed for monitoring such casting furnaces, can be used to register the necessary data.

DETAILED DESCRIPTION OF PREFERRED EMBODIMENTS

Figure 1:
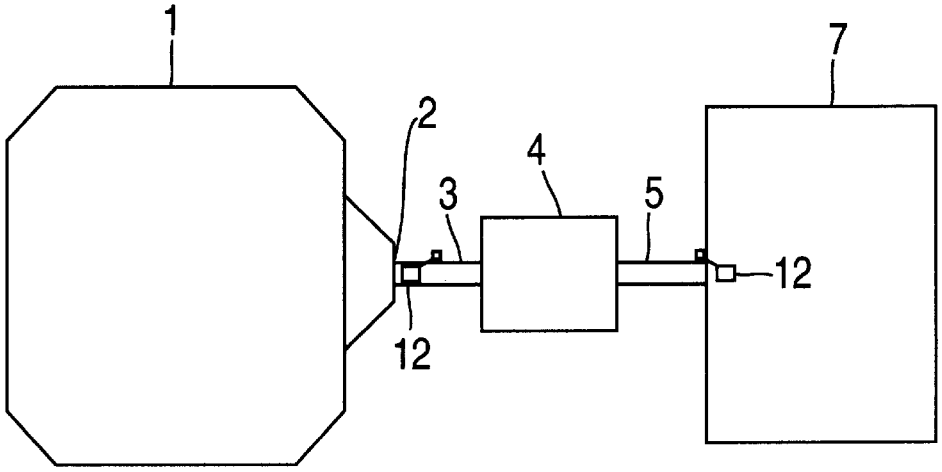
FIG. 1 shows a top view at a tiltable casting furnace with launder system.
Figure 2:
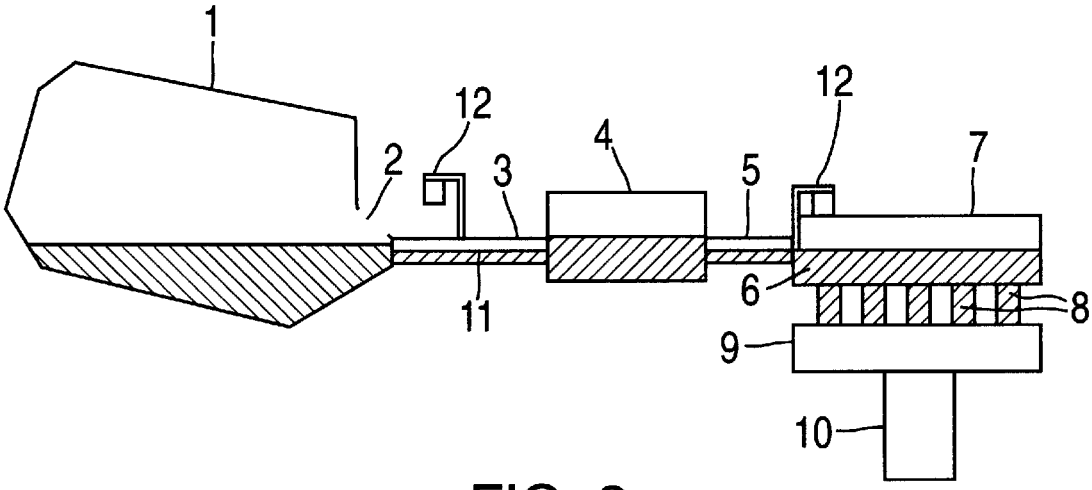
FIG. 2 shows an elevation of the furnace in FIG. 1 in section.

On FIGS. 1 and 2 there are shown a casting furnace 1 for aluminium. The furnace 1 is tiltable and has an outlet opening 2. When the furnace is tilted, metal flowing out from the outlet opening 2 fills a first launder 3, a filter unit 4, a second launder 5, and a distribution launder 6 on a casting table 7. From the distribution launder 6 the metal is distributed to a number of casting moulds (not shown) for vertical casting at bolts 8. During the casting process the lower ends of the bolts 8 rest on a vertical movable table 9 which during the casting process is lowered by means of an hydraulic cylinder 10. The table 9 is in conventional way contained in a casting well (not shown).

During the casting process the metal level in the first and second launders 3, 5 and in the distribution launder 6 is kept as stable as possible. The metal level is regulated by regulating the tilting angle for the casting furnace 1.

Figure 3:
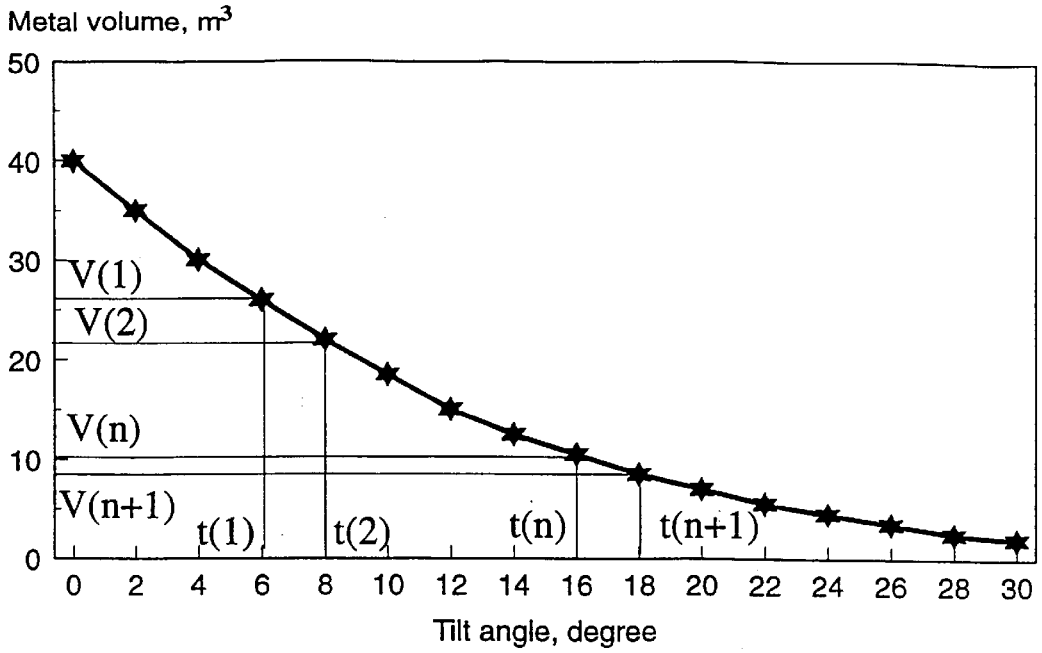
FIG. 3 shows a calculated curve for amount of metal in a casting furnace as a function of the furnace tilting angle.

The metal level is monitored by means of sensors 12. In FIG. 2 it is shown two sensors 12, but one sensor and more then two sensors can be used. In order to establish a reference curve for the amount of metal in the casting furnace 1 as a function of tilting angle according to the present invention, one start with a calculated curve for amount of metal in the casting furnace as a function of the tilting angle for the casting furnace 1. Such a calculated curve is shown in FIG. 3. It is not a requirement for the method of the present invention that the calculated curve showing the amount of metal in the casting furnace 1 as a function of the tilting angle is correct.

At the start of a casting process the furnace 1 is tilted such that metal flows from the furnace outlet opening 2 and fills the launders 3, 5 and 6 and the filter unit 4 to a reference level 11, whereafter the metal is allowed to flow into the moulds from the bolts 8.

In order to establish a connection between the volume of metal in the casting furnace as a function of the furnace tilting angle, the following procedure is followed:

The volume of metal contained in the launders 3, 5, 6 and in the filter units 4 is calculated for the reference metal level 11. This can for instance be done using the known geometry of the launders and the filter unit, but any other methods can be used. The volume of metal cast into the bolts 8 is calculated continuously based on the density of the metal, the cross-section of the bolts 8, the number of bolts 8 and the lengths of the bolts 8 at any time during the casting process. At the same time deviations from the metal reference level 11 in the launder system is monitored by means of the sensors 12 and the volume of metal tapped from the furnace is corrected as described above. Based on the above mentioned data, the volume of metal tapped from the furnace can be calculated and stored at any time during the casting process. This is preferably done by use of a computer furnished with the necessary data.

The amount of metal tapped from the furnace 1 from a tilting angle t (1) to a greater tilting angle t (2) is determined based on registered data for the two tilting angles. A requirement for this is that the metal level in the launder system is kept constant from tilting angle t (1) to tilting angle t (2). If the metal level changes from tilting angle t (1) to tilting angle t (2) one has to adjust the amount of metal tapped from the furnace as described above.

It is assumed that the volume of metal in the furnace 1 at tilting angle t (1) is on the curve shown in FIG. 3. The volume of metal at tilting angle t (2) is then plotted in the curve in FIG. 3. The straight line between the point for volume at tilting angle t (1) and the volume at tilting angle t (2) will then represent the slope for the interval t (1) to t (2) for the volume curve in FIG. 3. The registration of metal volume tapped from the furnace between one tilting angle and a greater tilting angle is repeated for a plurality of intervals of tilting angles during the casting process and the slopes for a real volume curve can thereby be calculated for a plurality of intervals of tilting angles. In FIG. 3 it is for simplicity only showed to such registrations. If the metal level deviates from the reference level 11 one must adjust for metal tapped from the furnace as described above.

The registration of slopes as described above, is repeated for a number castings from the casting furnace 1, whereby a number of parallels for the slopes are registered for each interval.

Based on the slopes as calculated above it is then constructed a real curve for volume of metal tapped from the furnace as a function of tilting angle within the interval of slopes where the flow of metal from the furnace has been registered. Such a curve A for volume of metal tapped form the furnace as a function of the furnace tilting angle is shown in FIG. 4.

Figure 4:
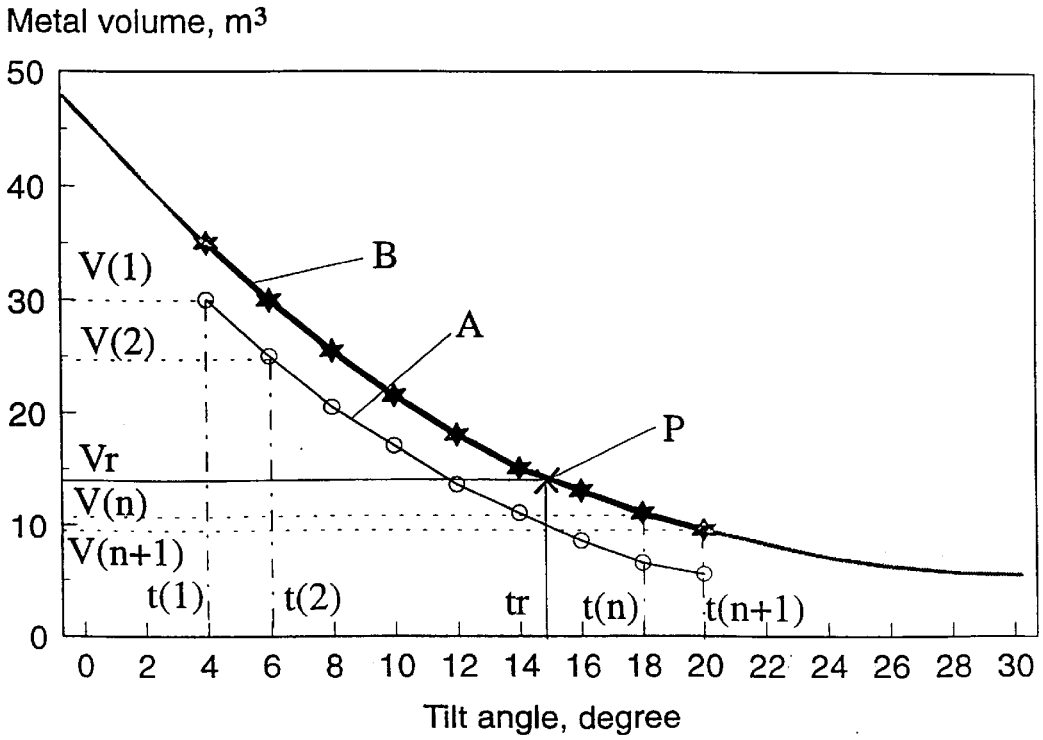
FIG. 4 shows a curve A for amount of metal tapped from the furnace as a function of the tilting angle and a reference curve B for amount of metal in the furnace as a function of the furnace tilting angle, and where.

As described above, the slopes which are the basis for the construction of curve A in FIG. 4 is calculated based on volume of metal tapped form the casting furnace 1 in intervals from one tilting angle to a greater tilting angle. The curve A therefore does not give an exact value for volume of metal contained in the furnace for a certain tilting angle. In order to adjust the curve A in FIG. 4 in such a way that it shows the actual volume of metal contained in the furnace at a certain tilting angle, the following procedure is followed:

1. The furnace is completely emptied.
2. A known volume of metal is charged to the furnace.
3. The outlet opening 2 for the casting furnace 1 is closed and the furnace is tilted to a tilting angle where the level of metal in the outlet opening 2 is at the metal reference level.

This tilting angle is plotted in the curve as shown by the point P in FIG. 4. The constructed curve A is thereafter staggered along the volume axis in curve A in FIG. 4 until the curve hits the point P. A reference curve B showing volume of metal in the casting furnace I as a function of the furnace tilting angle is thereby obtained.

As mentioned above, curve A and thereby also reference curve B, are only valid inside the range of tilting angles where the slopes have been measured. The reference curve B is therefore not valid for a completely or nearly completely filled furnace or for a nearly empty furnace. One can, however, extend the reference curve B to both small tilting angles and to very large tilting angles by repeating the procedure described above for determining the point P in FIG. 4. Thus one can charge the furnace full or nearly full with a known amount of metal and thereafter, with closed outlet opening 2, tilt the furnace to such a tilting angle that the metal level in the furnace outlet opening 2 is equal to the reference level 11, and thus determine the starting point of the reference curve B. In the same way one can charge a small known volume of metal to empty furnace and determine the tilting angle for this known amount of metal and thereby be able to plot in points in the reference curve B at very high tilting angles.

Figure 5:
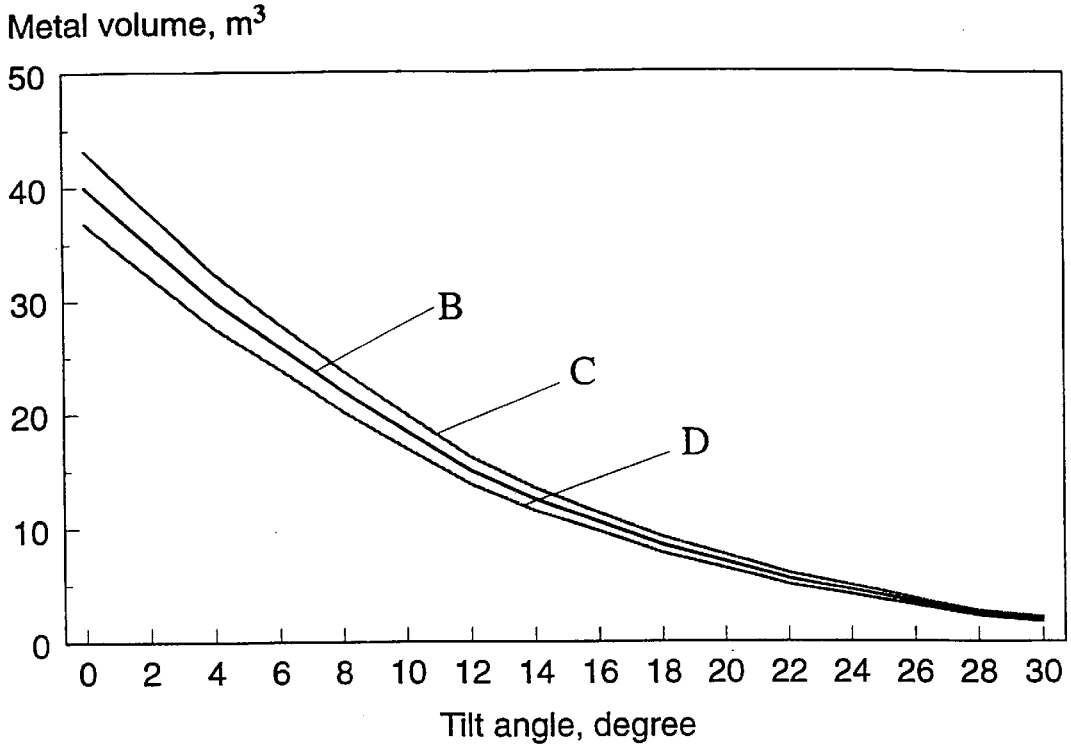
FIG. 5 shows reference curve B with limit values.

When the reference curve B has been established, curves for limit values are plotted on both sides of the reference curve B as shown by the curves C and D in FIG. 5.

The reference curve B can now be used in order to determine amount of metal in the furnace during future casting processes from the casting furnace until a new corrected reference curve is established.

The amount of metal in the furnace is read from the reference curve B. However, if the actual level of metal deviates from the reference metal level 11, the amount of metal read from the reference curve B must be adjusted in the following way:

If the actual registered metal level is higher than the reference level, the amount of metal in the furnace read from the reference curve B is adjusted by adding a correction corresponding to the amount of metal in the furnace which is above the reference level 11. The amount of metal in the furnace between the reference level 11 and registered actual metal level can be calculated based on the furnace geometry, the tilting angle and the distance from the reference level to the registered actual metal level.

If the registered actual metal level is lower that the reference level 11 the above correction is made by subtraction from the amount of metal in the furnace read from the reference curve B.

The reference curve B is controlled by for each casting registering the volume of metal tapped from the furnace for a plurality of intervals of tilting angles between a tilting angle and a greater tilting angle in the way described above in connection with establishing the reference curve B. These data are stored and are used to calculate a curve for volume of metal in the casting furnace as a function of tilting angles. This curve is compared to the reference curve B and if the calculated curve generally is with the area between curve C and D, the same reference curve B is used also for the next casting. In this way the calculated curve for volume of metal in the furnace as a function of tilting angle is compared with the reference curve for each casting. The amount of metal remaining in the furnace will thereby be known at any time during the casting process and one can ensure that bolts of a predetermined length can be obtained. Further the content of metal in the furnace after finishing a casting will be known.

If the calculated curve for amount of metal as a function of tilting angle for one or more casting falls without the area defined by curve C and D in FIG. 5, it is first controlled that the calculation of metal tapped from the furnace is correct. If this calculation is correct it is established a new reference curve in the way described above.

What is claimed is:

1. A method for measuring volume of liquid metal in a tiltable casting furnace as a function of tilt angle of the furnace, wherein said furnace has an outlet through which liquid metal is poured from the furnace into a launder, said launder being in fluid communication with said outlet and said launder being in fluid communication with molds in which said liquid metal solidifies, said method comprising:

(a) establishing a reference curve for the volume of the liquid metal in said tiltable casting furnace as a function of said tilt angle of said furnace at a reference level for liquid metal at said outlet, said reference level being a selected level for liquid metal in said outlet when said liquid metal is poured through said outlet and into said launder, said reference curve having a volume axis and a tilt angle axis;

(b) measuring an actual level of said liquid metal at said outlet and calculating a difference in volume of liquid metal in said furnace based on a difference between said actual level of liquid metal at said outlet and said reference level of liquid metal at said outlet;

(c) measuring the tilt angle of said furnace, determining a volume of liquid metal in said furnace based on said measured tilt angle and said reference curve; and (d) determining an actual volume of liquid metal in said furnace by adding said volume based on said reference curve to the difference in volume determined in (b).

2. The method of claim 1 wherein the measuring of the level of liquid metal at said outlet is performed by a sensor.

3. The method of claim 1 wherein the establishment of said reference curve comprises:

(a1) calculating a curve for volume of liquid metal in said furnace as a function of tilt angle based on the geometry of said furnace, said calculated curve having a volume axis and a tilt angle axis;

(a2) measuring volume of liquid metal tapped from the furnace for a plurality of intervals from one tilt angle to a greater tilt angle to obtain data, said data being obtained at a constant level of liquid metal at said outlet, said data being used to correct said curve calculated in (a1) above to obtain a constructed curve;

(a3) recharging the furnace with a known amount of liquid metal, tilting the furnace to obtain said reference level at said outlet and to obtain one exact point for said known volume at said tilt angle; and (a4) shifting said constructed curve along the volume axis of said constructed curve to bisect said one point thereby obtaining said reference curve.

4. The method of claim 3 wherein the volume of liquid metal tapped from the furnace for each of said plurality of intervals is measured based on the volume of the molds used for casting.

5. The method of claim 3 wherein step (a3) is repeated to obtain more than one exact point.

6. The method of claim 1 further comprising establishing two limit curves, a first limit curve being above said reference curve and a second limit curve being below said reference curve.

7. The method of claim 6 wherein said actual volume of liquid metal in said furnace is between said first and second limit curves and said reference curve is used to calculate the volume of liquid metal in the furnace.

8. The method of claim 6 wherein said actual volume of liquid metal in said furnace is outside either said first or said second limit curves and a new reference curve is established, said new reference curve being established from data obtained by measuring the volume of liquid metal tapped from the furnace during a plurality of intervals from one tilt angle to a greater tilt angle at said reference level for liquid metal at said outlet.

9. The method of claim 8 wherein the data is obtained from previous taps.

10. The method of claim 8 wherein the data is obtained from future taps, future in time based on the point in time when the reference curve is outside said first and second limit curves.

* * * * *